United States Patent [19]

Underwood

[11] Patent Number: 4,657,422

[45] Date of Patent: Apr. 14, 1987

[54] BINDER

[76] Inventor: Theodore A. Underwood, P.O. Box 1205, South Lancaster, Mass. 01561

[21] Appl. No.: 878,638

[22] Filed: Jun. 26, 1986

[51] Int. Cl.[4] ..... B42F 13/12; B42F 13/00

[52] U.S. Cl. ..... 402/61; 402/68

[58] Field of Search ..... 402/8, 22, 60, 61, 63, 402/64, 65, 68, 80 P, 80 R; 281/24, 25 R, 28, 31, 38; 29/33.2, 33.5; D8/DIG. 8; D19/32, 33, 65

[56] References Cited

U.S. PATENT DOCUMENTS 1,900,601 3/1933 Felder ..... 402/66

4,529,226 7/1985 Weiman ..... 402/63

*Primary Examiner*—Paul A. Bell

*Assistant Examiner*—Paul M. Heyrana

*Attorney, Agent, or Firm*—Charles R. Fay

[57] ABSTRACT

A manually filled and operated binder for stacks of similarly apertured sheets, having a sidewall pierced at mutually spaced points. The outer aspect of the apertured wall is countersunk at the pierce hole. The opposite wall is provided with recesses aligned with the countersunk aperture for receiving pins to secure sheets having apertures in alignment with the apertures of the sidewalls.

17 Claims, 5 Drawing Figures

BINDER

FIELD OF THE INVENTION

This invention is essentially a "ring" binder for loose, apertured stacks of sheets.

BACKGROUND OF THE INVENTION

Manually filled and operated snap-ring binders for stacks of similarly apertured sheets have long been known, but those types of binders or holders do not lend themselves to modern machine filling and assembling machinery. It has been proposed to make the binders and sheet securing pins of plastic while still adhering to manual actuation, or partial actuation by machine. In some cases plastic binders have been utilized for permanent binding, or manual opening for sheet addition with difficulty. It is the object of this invention to bind stacks of sheets by automatic machinery by means of binders that can subsequently easily be opened manually for sheet changing or additions and manual re-closing and securement.

SUMMARY OF THE DISCLOSURE

The present binder comprises an elongated narrow rectangular molded plastic box-like member having one open edge, three complementary closed or solid walls, including a pair of spaced side walls and a bottom wall, and closed ends. The plastic is self-sustaining and semi-rigid, and the side walls are slightly flexible under manual pressure but normally are flat, plain and co-extensive in fixed relation with the bottom wall and the ends.

One side wall is pierced at mutually spaced points, usually three in number. The outer aspect of this apertured wall is countersunk at the pierced holes, and the opposite wall is provided with recesses aligned with the countersunk apertures. These recesses may be countersunk also or made in two diameters, the lesser of which extends farther into the wall. The outside aspect of the recessed wall is continous, not apertured at all, so that the recesses have solid bottoms.

Plastic pins are provided, one for each hole. These pins are preferably cylindrical and solid, each with a head shaped to fit the corresponding apertured hole, and a reduced free end opposite the head to fit the recess in the opposite wall. Each pin has a small outstanding peripheral ridge just under the head, the diameter of the ridge being just slightly greater than the smallest diameter of the countersunk hole. When the reduced free end of a pin lodges in a recess, and is there by held against lateral play, the ridge snaps under the small edge of the respective hole and anchors the pin in position. By manually flexing the apertured wall inwardly, the ridge is snapped out of its hole and the pin can be removed to allow change or addition of sheets held in the binder.

This new and improved construction provides for continuous automatic machine processing. The stacks of apertured sheets progress in line to a binder station where during a brief halt, the binder with holes uppermost, is applied to the stack, the holes in the binder aligning with holes in the sheets. Pins are fed down into the holes in the wall of the binder, through the sheets, and into the opposite binder wall, fastening the sheets. The sheets are easily released by flexing the apertured wall of the binder downwards, releasing the ridge of the pins from the binder, so that they can be removed. After adding or changing sheets, the binder is easily reassembled to the stack of sheets, as manually.

PREFERRED EMBODIMENTS OF THE INVENTION

Figure 1:
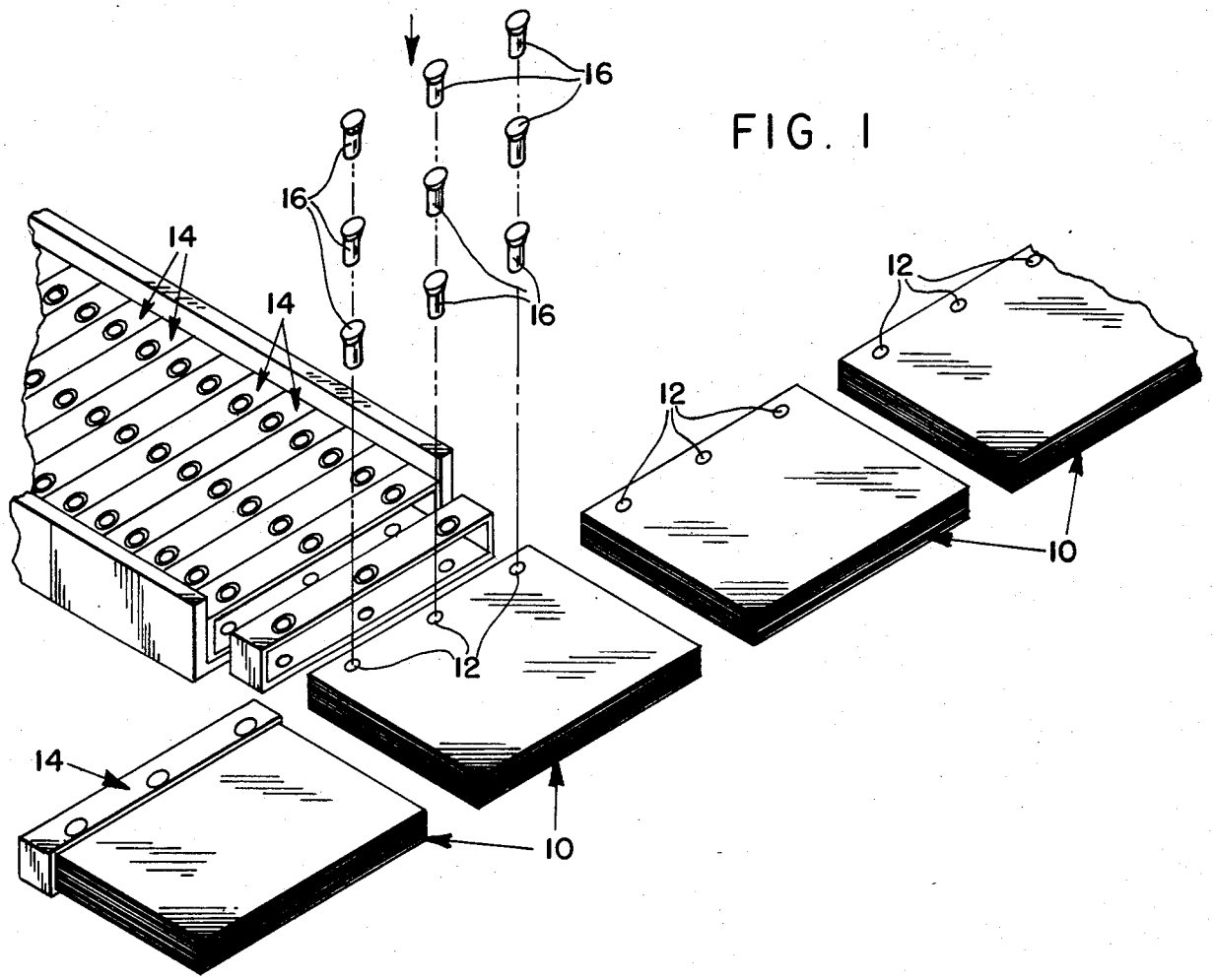
FIG. 1 is a perspective flow diagram, showing the machine application of the binders to stacks of sheets.
Figure 2:
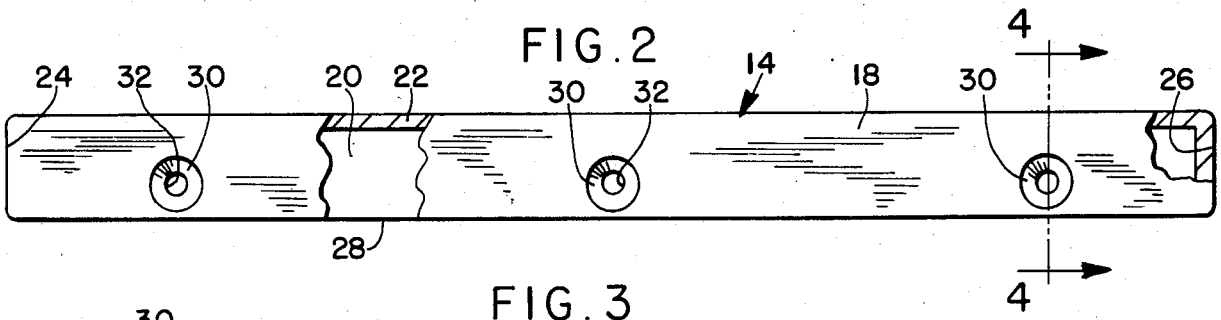
FIG. 2 is a plan view of a binder according to the present invention, part being in section.
Figure 3:
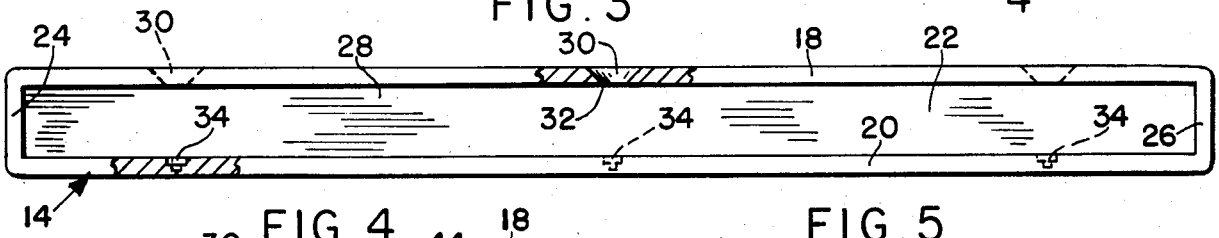
FIG. 3 is a front elevational view of the binder of FIG. 2; parts being in section.

Briefly stated, FIG. 1 shows a flow diagram of the action of an automatic machine for binding stacks of sheets as at 10, which have aligned holes 12 in them to receive the fasteners of binders 14 by means of pins 16. The stacks, binders, and pins move as indicated by arrows: the line of stacks stops, the binder advances, and the pins discend; then the line of sheets moves another step.

Each binder 14 comprises a front wall 18, a spaced parallel rear wall 20, a bottom 22, and two closed ends 24, 26, leaving the only opening the top at 28. This opening extends the length of the binder except for the end walls 24,26, and the stacks 10 receive the binders with wall 18 overlying the punched holes 12 and the corresponding edge portions of the stacks. The binder wall 18 is provided with holes 30 that are evenly mutually spaced and are countersunk, leaving edges 32 at the inner aspect of wall 18. The outer face of wall 20 is clear, continous, and plain, but its inner aspect has recesses 34 aligned with holes 30 but smaller. These recesses may be countersunk, FIG. 4., or stepped, FIG. 5., but they do not extend through wall 20.

Figure 4:
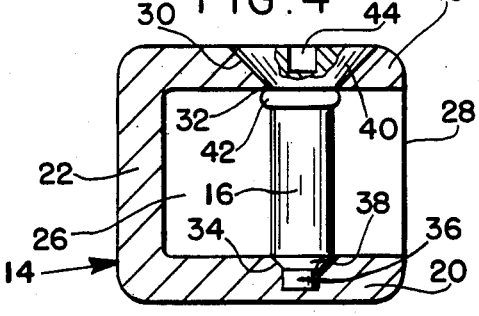
FIG. 4 is a sectional view on line 4 4 of FIG. 2.
Figure 5:
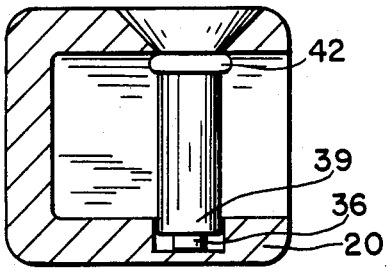
FIG. 5 is a view showing a slight modification of the showing in FIG. 4.

The pins 16 each has a forward reduction 36 that to fit the reduced recess 34, and may be beveled at 38, FIG. 4, or stepped as at 39 in FIG. 5. In either case, the reduced ends 36 ensure seating of the forward pin end in recess 34, and good diametric fit when seated. The other or trailing end of each pin has an undercut beveled head as shown at 40 to seat in countersunk holes 30, and between the head 40 and reduction 36, the pins are of constant diameter less than the head and greater than the reduction. At the end of the portion of the pin of constant diameter adjacent the head, there is an outstanding circular ridge 42 which is of less diameter than the head but greater than the diameter of the pin portion of constant diameter and greater than the diameter of the edge 32.

Thus, when the pins are thrust down to enter holes 30 in binder wall 18 and holes 12 in the sheet stack, they seat at the reduced ends 36 in recesses 34, and are positioned therein, just as the ridge 42 snap past edges 32 of holes 30, and mold the pins in fixed relation to the sheet stacks and to the binders.

To remove and replace sheets, it is only necessary to manually depress wall 18 in the areas of the pins, snapping ridges 42 relatively upwardly, releasing the pins and allowing them to be withdrawn, freeing the sheets. When sheets are removed or replaced, the pins are reapplied but this time manually or in a press, again snapping ridges 42 under the edge portions of holes 30. The pins may be provided with axial end openings or recesses 44 for the temporary application of mechanical fingers, not shown, in the assembly.

I claim:

1. A binder comprising a front wall, a spaced parallel rear wall, a bottom wall connecting the front and rear walls, said walls all being elongated, the front wall being apertured, the rear wall being continuous and solid, the front and rear walls each having outer sides facing away each other and inner sides facing each other, the outer sides of the rear wall being unimpeded, the outer side of the front wall being countersunk at the apertures, and the inner side of the rear wall having a recess smaller than and axially aligned with each aperture, a separate pin for each aligned aperture and recess, each pin having an undercut head corresponding to its respective countersunk aperture, and a reduced free end opposite the head corresponding to its respective recess, said heads and reduced ends positioning the respective pin in the binder, an outstanding element on each pin adjacent the head thereof, said element having a radial dimension that snaps under the edge portion of a respective aperture to lodge at the inner side of the front wall and lock the pin in place as the head of the pin is seated in its countersink and the reduced end in its recess.

2. The binder of claim 1 wherein the binder consists of a self-supporting, slightly flexible material whereby the front and rear walls are capable of sufficient flexure under manual pressure to release the pins from the binder.

3. The binder of claim 1 including end walls for the binder, said end walls securing the front, rear, and bottom walls.

4. The binder of claim 1 wherein the element is substantially circumferential relative to the pin.

5. The binder of claim 1 wherein the element is located in more than a single position circumferentally of the pin.

6. The binder of claim 1 wherein the element is a circumferential ridge having a diameter greater than the diameter of its respective aperture at the inner side of the front wall.

7. The binder of claim 1 wherein each recess has a small diameter closely receiving the reduced end of its pin, and a greater diameter inwardly thereof to aid in centering reduced pin in the recess.

8. The binder of claim 7 wherein a larger diameter portion of the pin is received in the greater diameter portion of the recess.

9. A loose-leaf binder applicable to and removable from one or more apertured sheets, wherein the binder is manually or machine applied and manually removable, said binder comprising a pair of narrow elongated spaced walls adapted to receive the sheet or sheets there between, each wall having an outer side and an inner side, the outer sides facing away from each other and the inner sides facing each other, at least one aperture through one wall, the other wall being continous and uninterruped at its outer side, a recess in the inner side of the said other wall, the recess being aligned with the aperture, and a pin, a head on the pin greater in dimension than the aperture, the pin being receivable in the aperture and stopped by the head in the recess, the pin being adapted to pass through the aperture in the sheet, securing it to the binder, and means to connect the pin to the binder temporarily wherein said means comprises a portion on the pin having a dimension to snap under the portion of the said one wall surrounding the aperture in said one wall.

10. The binder of claim 9 wherein the walls are semi-flexible and are capable of flexture toward each other to free the means from the said one wall.

11. The binder of claim 9 wherein the aperture in the said one wall is countersunk at the outer side thereof and the head of the pin is beveled to fit the same.

12. The binder of claim 9 wherein the means is a circumferential element.

13. A binder for one or more apertured sheets, said binder comprising a pair of spaced, parallel, elongated self-sustaining semi-flexible walls, an aperture in one wall, a pin, a head on the pin, said pin having a free end opposite the head, said pin being receivable in the aperture in the one wall and the sheet, the head stopping the pin, in its motion through said apertures with the free end of the pin closely adjacent the other wall, and means being on the pin and being greater in diameter than the aperture in the one wall and having the capability of snapping past the aperture edges to prevent accidental removal of the pin from the binder.

14. The binder of claim 13 wherein the semi-flexible walls are capable of manual flexture toward each other to disengage the means on the pin from the said one wall to release the pin therefrom, the free end of the pin engaging the other wall during said flexure.

15. A loose-leaf binder comprising a pair of narrow, elongated, spaced walls, an aperture in one wall, a separate pin placed in the aperture, a head on the pin stopping the pin located in the aperture, means on the pin adjacent the head underlying the apertured wall and in contact therewith to lock the pin in place when located in the aperture with the head in overlying position relative to the apertured wall, and means securing the walls together.

16. The binder of claim 15 wherein the walls are self-sustaining but semi-flexible, and the end of the pin opposite the head there of contacts the wall opposite the apertured wall, whereby the walls are adapted to be flexed toward each other to release the pin from the apertured wall.

17. The binder of claim 16 wherein the means to lock the pin to the apertured wall is an enlargement of the pin.

* * * * *